US010739010B2

(12) United States Patent
Bassetti et al.

(10) Patent No.: US 10,739,010 B2
(45) Date of Patent: Aug. 11, 2020

(54) METHOD OF OPERATING A GAS BURNER OF A COOKING APPLIANCE

(71) Applicant: Electrolux Home Products Corporation N. V., Brussels (BE)

(72) Inventors: Alex Bassetti, Forli (IT); Fabio Spano, Forli (IT)

(73) Assignee: Electrolux Home Products Corporation N.V., Brussels (BE)

( * ) Notice: Subject to any disclaimer, the term of this patent is extended or adjusted under 35 U.S.C. 154(b) by 450 days.

(21) Appl. No.: 14/417,395

(22) PCT Filed: Jul. 30, 2013

(86) PCT No.: PCT/EP2013/065943

§ 371 (c)(1),
(2) Date: Jan. 26, 2015

(87) PCT Pub. No.: WO2014/032885

PCT Pub. Date: Mar. 6, 2014

(65) Prior Publication Data

US 2015/0184866 A1 Jul. 2, 2015

(30) Foreign Application Priority Data

Aug. 28, 2012 (EP) ..... 12181945

(51) Int. Cl.
*F24C 3/12* (2006.01)
*F23N 5/20* (2006.01)

(52) U.S. Cl.
CPC ..... *F24C 3/12* (2013.01); *F23N 5/20* (2013.01); *F23N 5/203* (2013.01); *F24C 3/126* (2013.01)

(58) Field of Classification Search
None
See application file for complete search history.

(56) References Cited

U.S. PATENT DOCUMENTS 3,307,824 A * 3/1967 Weisheit ..... F16K 31/02 137/487.5
3,392,740 A * 7/1968 Fleer ..... G05D 23/128 137/65

(Continued)

FOREIGN PATENT DOCUMENTS

DE 9407567 7/1994
DE 19949600 4/2001

(Continued)

OTHER PUBLICATIONS

Machine translation of JP2006308228, attached as "JP2006308228 wipo translate.pdf" generated Sep. 26, 2018, but JP2006308228 published 2006. (Year: 2006).*

(Continued)

*Primary Examiner* — Avinash A Savani
*Assistant Examiner* — Martha M Becton
(74) *Attorney, Agent, or Firm* — Pearne & Gordon LLP

(57) ABSTRACT

The invention is directed to a method of operating a gas burner (2, 3) of a gas cooking appliance (1). The gas burner (2, 3) comprises a safety valve (7) for closing and opening gas supply to the gas burner (2, 3) and a step valve (8) for setting a gas flow rate to the gas burner (2, 3). Shut-off of the gas burner (2, 3) comprises closing the safety valve (7) while leaving the step valve (8) open at least for a predetermined period of time from complete closure of the safety valve (7).

20 Claims, 6 Drawing Sheets

(56) References Cited

U.S. PATENT DOCUMENTS 3,595,273 A * 7/1971 Kolodziej ..... F16K 31/48 137/614.12
3,773,027 A * 11/1973 Dodd ..... F24C 1/10 126/214 A
3,832,123 A * 8/1974 Walbridge ..... F23N 5/123 431/78
4,201,184 A * 5/1980 Scheidler ..... F24C 3/047 126/214 A
4,318,687 A * 3/1982 Inoue ..... F23N 5/105 431/54
4,434,933 A * 3/1984 Tamura ..... F16K 31/0655 236/75
4,681,084 A * 7/1987 Grech ..... F24C 3/126 126/39 E
4,766,921 A * 8/1988 Williams ..... G05D 3/18 137/1
4,836,770 A * 6/1989 Geary ..... F23N 5/203 431/46
4,856,983 A * 8/1989 Geary ..... F23N 5/203 431/27
4,997,161 A * 3/1991 Hutchison ..... F23N 1/005 126/39 E
5,094,259 A * 3/1992 Hsu ..... F23N 5/123 137/614.11
5,241,463 A * 8/1993 Lee ..... F24C 3/126 126/39 BA
5,388,984 A * 2/1995 Meslif ..... F23N 1/005 137/1
5,575,638 A * 11/1996 Witham ..... F23N 5/203 126/39 BA
5,924,857 A * 7/1999 Frasnetti ..... F23N 5/203 126/39 BA
5,947,370 A * 9/1999 Rona ..... F23N 1/022 236/20 A
6,116,230 A * 9/2000 Clifford ..... A47J 37/0713 126/39 BA
6,698,417 B2 * 3/2004 Frasnetti ..... F23N 5/102 126/39 BA
7,255,100 B2 * 8/2007 Repper ..... F23N 1/005 126/39 BA
7,669,590 B2 * 3/2010 Oberhomburg ..... F24C 3/126 126/214 R
8,100,121 B2 * 1/2012 Clauss ..... F24C 3/126 126/25 R
8,353,281 B2 * 1/2013 Oberhomburg ..... F23N 1/002 126/39 BA
8,469,019 B2 * 6/2013 Barritt ..... F23N 1/002 126/39 BA
8,475,162 B2 * 7/2013 Barritt ..... F23N 1/002 126/39 BA
2002/0045142 A1 * 4/2002 Repper ..... F23N 1/005 431/66
2002/0094498 A1 * 7/2002 Rodriguez-Rodriguez ..... F23N 5/203 431/18
2005/0208443 A1 * 9/2005 Bachinski ..... F23D 14/84 431/8
2005/0241631 A1 * 11/2005 Puricelli ..... F24C 3/085 126/39 E
2008/0216810 A1 9/2008 Clauss et al.
2009/0023105 A1 * 1/2009 Yeung ..... F23Q 9/04 431/6
2010/0239987 A1 * 9/2010 Baier ..... F24C 3/126 431/6
2013/0153062 A1 * 6/2013 Young ..... F23N 1/002 137/557

FOREIGN PATENT DOCUMENTS

| | | |
|---|---|---|
| DE | 102009027399 | 1/2011 |
| EP | 0514212 | 11/1992 |
| EP | 1215441 | 6/2002 |
| EP | 1528326 | 5/2005 |
| EP | 2189719 | 5/2010 |
| EP | 2312212 | 4/2011 |
| EP | 2469172 | 6/2012 |
| GB | 2233756 | 1/1991 |
| JP | S63156916 | 6/1988 |
| JP | 2003222327 | 8/2003 |
| JP | 2006308228 | 11/2006 |
| WO | 0129483 | 4/2001 |
| WO | 2005031215 | 4/2005 |
| WO | 2007020178 | 2/2007 |
| WO | 2007100611 | 9/2007 |
| WO | 2008155278 | 12/2008 |
| WO | 2009040115 | 4/2009 |
| WO | 2009040243 | 4/2009 |

OTHER PUBLICATIONS

International Search Report for PCT/EP2013/065943, dated Oct. 17, 2013, 2 pages.
Opposition document (in German) filed in related EP Patent No. 2,703,723 with English-language translation of pp. 1 and 8-32. pp. 2-7 include information that is not salient to the substantive arguments (i.e., Opponent's Request, Listing of Evidence and Subject Matter of the Patent) and are not included in the English-language translation.
Decision in Opposition Proceedings for EP application 12181945.2, dated Mar. 11, 2019, 36 pages.
JP2006308228 previously cited in IDS filed Oct. 3, 2017: English translation of paragraph 31, dated Mar. 19, 2019. 1 page.
Communication to the EPO filed in EP12181945.2 dated Dec. 2, 2019, 12 pages.
Grounds of Appeal filed by BSH Hausgerate GmbH in related EP application No. 12181945.2 dated Jul. 11, 2019, 27 pages, with English language translation.
Response to Grounds of Appeal filed by BSH Hausgerate GmbH in related EP application No. 12181945.2 received Nov. 20, 2019, 186 pages.
Grounds of Appeal filed by Applicant in related EP application No. 12181945.2 dated Jul. 18, 2019, 47 pages.

* cited by examiner

METHOD OF OPERATING A GAS BURNER OF A COOKING APPLIANCE

The present invention is directed to a method of operating a gas burner of a cooking appliance, such as a cooktop, a stove, an oven or a gas hob, in particular of a household cooking appliance.

Gas cooking appliances are widely known in particular due to the increasing availability in gas supply. The operation of gas cooking appliances in general requires the control of gas valves inter alia controlling the gas supply to single gas burners of the gas cooking appliances.

The control of single gas burners of a gas cooking appliance, in particular the control of respective gas valves can be regarded as a major issue for optimizing operating and heating efficiency as well as energy consumption of the gas burners or gas cooking appliances. In view of known gas burners and gas cooking appliances there is still room for further improving operation of respective gas burners, in particular for improving operation of gas valves of the gas burners.

In particular, it would be desirable to operate a gas burner so as to output a heating power whose minimum value is lower of that obtainable with a known gas burner.

Therefore it is one of the objects of the invention to improve the operation of gas burners, in particular gas burners of gas cooking appliances for professional and/or household use. In particular, a method of operating a gas burner and a cooking appliance arranged for carrying out said method shall be provided.

According to claim 1, a method of operating a gas burner of a cooking appliance, in particular of a household gas cooking appliance, is provided.

The gas burner comprises a safety valve adapted to close and open a gas supply, in particular a gas supply line, to the gas burner. Note that the safety valve shall be understood to represent a valve assigned to a single gas burner and which is adapted to enable and shut-off gas supply to the gas burner. If the safety valve is closed, no gas can reach or pass the respective gas burner. Whereas if the safety valve is open, gas may be supplied to the gas burner assigned to the safety valve.

The gas burner further comprises a step valve which is adapted and designed for setting, in particular varying or modulating, a gas flow rate to the gas burner. Modulation of the gas flow rate may for example be obtained by a stepper motor adapted to move an internal plug of the step valve. Note that the safety valve and the step valve are coupled in such a way that in case that the safety valve is closed, no gas can be supplied to the gas burner even if the step valve is, at least partially, opened.

If desired, the safety valve and the step valve may be incorporated or mounted as a valve combination in a single valve body. The valve combination in particular may be a modulating electrovalve.

According to claim 1 it is provided, that a shut-off, in particular a shut-off operation or a power-off or switching-off operation, of the gas burner comprises closing the safety valve while leaving the step valve open at least for a predetermined period of time from complete closure of the safety valve. This in particular implies that the width or size of opening of the step valve is kept constant for a certain period of time, i.e. the step valve is not operated in or after the event of closure of the safety valve for a certain period of time. In particular, the step valve can be kept at a constant opening status until a subsequent start-up has to be carries out.

Keeping the step valve at a constant opening status at least for a predetermined time interval may help to reduce wear of the step valve. The fact that the step valve, if at all, can be moved comparatively slowly may contribute to reduced wear.

With the proposed method, gas shut-off and start-up generally is controlled exclusively by the safety valve, which in general is less prone to wear.

One further advantage of the proposed method is that the opening states and sizes of the safety valve and the step valve are clearly defined at any point of time, in particular after a shut-off of the gas burner. This is of advantage in particular for a subsequent start-up operation.

It shall be noted, that the term "shut-off" indeed may mean that gas flow and flames of the gas burner are extinguished completely. The term "start-up" in particular shall mean a process for transferring the gas burner from the shut-off state to an operating stage, in which the gas burner emits heat by burning gas fed to the gas burner.

In one embodiment of the method, it is provided that the shut-off represents a final shut-off after an operational phase. The operational phase or an operational cycle of the gas burner may be a continuous or intermittent operational phase of the gas burner. The term "final shut-off" shall be distinguished from "intermittent shut-off", used and occurring in connection with operating the gas burner in intermittent mode.

The term "continuous mode" shall mean that the gas burner is operated continuously. This in particular means that no shut-off and subsequent start-up of the gas burner occurs between an initial start-up and a final shut-off.

The term "intermittent mode" shall mean that the gas burner is shut-off and started-up again for at least a couple of times between the initial start-up and the final shut-off. Operating the gas burner in intermittent mode in particular has the advantage that the heat output of the gas burner can be moved below the minimal heat output obtainable in continuous mode.

In the present embodiment, it is provided that upon complete closure of the safety valve, the step valve is gradually moved or transferred to the closed state. Moving or transferring the step valve to the closed state may be conducted according to a steady, in particular linear, function or motion. In this embodiment, in a first step, the safety valve is closed and then, the step valve is transferred to the closed state. This may be advantageous for safety reasons.

Transfer of the step valve to the closed state may be conducted comparative slowly, in particular in order to obtain a smooth and gentle operation of the step valve, which may reduce wear and which may be beneficial for the lifetime of the step valve.

With the present embodiment it may be provided that an optional idle time of the step valve is provided between complete closure of the safety valve and start of transfer of the step valve to the closed state. During this idle time or idle phase, the opening status of the step valve preferably is kept at a constant value. The length of the idle time may be freely selected.

It shall be noted, that the time point of transferring the step valve to the closed state may be determined automatically. For example, the operational state of all gas burners of a cooking hob may be detected, and in case that all gas hobs are in the deactivated state, in particular over a predetermined time period, a controller of the gas burner may decide or determine that the gas burner will probably not be used immediately or in near future and can then transfer the step valve to the closed state. In particular, implementing such an idle time may contribute to reduce mechanical operations of opening and closing the step valve. This may be advantageous with respect to the operating time of the step valve.

In one further embodiment, the gas burner is operated in an intermittent mode and the shut-off of the gas burner represents an intermittent shut-off. As to the term intermittent shut-off, reference is made to the description above.

Here, it shall be noted, that the shut-off as proposed in claim 1 advantageously applies both to final shut-offs and intermittent shut-offs. This may simplify operation of the gas cooking appliance.

In case of an intermittent shut-off it may be preferred that the opening state of the step valve is kept constant at least until a subsequent start-up action has to be carried out, i.e. at least between a preceding intermittent shut-off and a subsequent intermittent start-up.

In one variant, it is provided that the opening state or opening size of the step valve during intermittent operation is varied. In particular, the opening states or sizes of the step valve in subsequent intermittent cycles may differ from each other such that the gas flow rates vary of an amount that may be, for example, 10%. In odd intermittent cycles, the step valve may be in a minimal opening state for generating a minimal gas flow rate. In even intermittent cycles, the step valve may be opened such that a higher gas flow rate is obtained. Adjusting the flow rate via the step valve may be used for adjusting the heating power of the gas burner without requiring a change in the duty cycle of the intermittent operation of the gas burner. In this way cooking performances may be improved.

In a yet further embodiment, it is provided that start-up of the gas burner comprises transferring the step valve to an ignition opening state, opening the safety valve and generating an ignition via a spark or through a hot surface like a glow wire. The term "start-up" thus means that after start-up the gas burner can supply heat, in particular to cookware placed thereon. With the proposed embodiment, ignition of the gas can be accomplished in a comparatively secure and reliable way. It shall be noted that the ignition opening state of the step valve preferably is the fully opened state of the step valve. However, any intermediate opening size or state, in particular a minimal opening size or state may be used as the ignition opening state.

In a further embodiment, the gas burner is operated in continuous mode and the opening state of the step valve is adjusted according to user settings, i.e. settings inputted by the user. By adjusting the opening state of the step valve, the heat output of the gas burner can be adjusted according to respective needs. A user interface may be provided for detecting and picking up user inputs. If desired, an automatic control may be provided for adjusting the opening state of the step valve when the gas burner is operated in continuous mode. This is particular advantageous when pre-determined cooking programs have to be performed.

In a further embodiment, the gas burner is operated in intermittent mode and the start-up represents an intermittent start-up. The intermittent start-up comprises transferring the step valve from a given, in particular minimal, opening state, to the ignition opening state, opening the safety valve and generating an ignition via a spark or through a hot surface like a glow wire. As can be seen, the start-up procedures of the gas burner for an intermittent start-up and for an initial start-up may comprise identical steps. Such unified operational modes in particular may contribute to simplified operation and control of the gas cooking appliance, in particular of the safety valve and step valve.

According to claim 10, a method of operating a gas burner is provided, wherein the gas burner comprises at least one first and second burner ring, in particular an inner and an outer burner ring, wherein at least one of the first and second burner rings is operated according to a method as described further above, including any embodiments and variants thereof. As to advantages and advantageous effects, reference is made to the description above and further below. In the present case or embodiment, the gas burner is a multi-burner, in particular double burner or a double inlet burner. It shall be noted that the proposed method of operating a gas burner can advantageously be applied both to single inlet and double inlet burners. This greatly simplifies operation of the gas burner.

In one embodiment of the method according to claim 10, the gas burner is operated in intermittent mode. Here, it may be that the first burner ring is operated in intermittent mode while the second burner ring is kept in a shut-off, i.e. switched off, state. In particular in this case, the first burner ring may be the inner ring and the second burner ring may be the outer ring. Operating only the first burner ring means that the safety valve and step valve of the second burner ring, i.e. the outer burner ring, can be kept in a closed state or can be transferred to the closed state. In this way it is possible to have a multi-burner suitable to produce a high heat power output and further able to generate a very low heat power output through an intermittent mode of operation, thereby covering a wide range of heat power output with a single multi-burner unit. Note that it is also conceivable to operate only the outer gas burner ring while leaving the inner gas burner ring in the deactivated state.

In a further embodiment of the method according to claim 10, the gas burner is operated in continuous mode, which in particular means that the first and second burner rings are operated in continuous mode. In this embodiment it is provided that the start-up, in particular an initial start-up of the first burner ring, is offset from the start-up, in particular initial start-up, of the second burner ring. The offset may be obtained in that the safety valves of the first and second burner rings are opened with a time delay. The step valves, however, may be transferred to the respective ignition opening state substantially simultaneously. As an example, the step valves may be transferred to the ignition opening state, and then, in a first stage, the inner burner ring may be ignited. After that, the safety valve of the outer ring may be opened and the outer ring may be ignited.

According to claim 14, a gas cooking appliance is provided. The gas cooking appliance comprises at least one gas burner and a control unit adapted to control the gas burner according to a method as described above, including all respective embodiments and variants. As to advantages and advantageous effects, reference is made to the description above.

According to claim 15, a gas cooking appliance may be in the form of a cooktop or a gas stove or an oven or a gas hob of professional- or household-type. As to advantages and advantageous effects, reference is made to the description above and further below.

In all it can be seen, the proposed method and gas cooking appliance are suitable for improving the operation of the gas burner.

Embodiments of the invention will now be described in connection with the annexed figures, in which.

Unless otherwise mentioned, like elements are designated by like reference signs throughout the figures.

Figure 1:
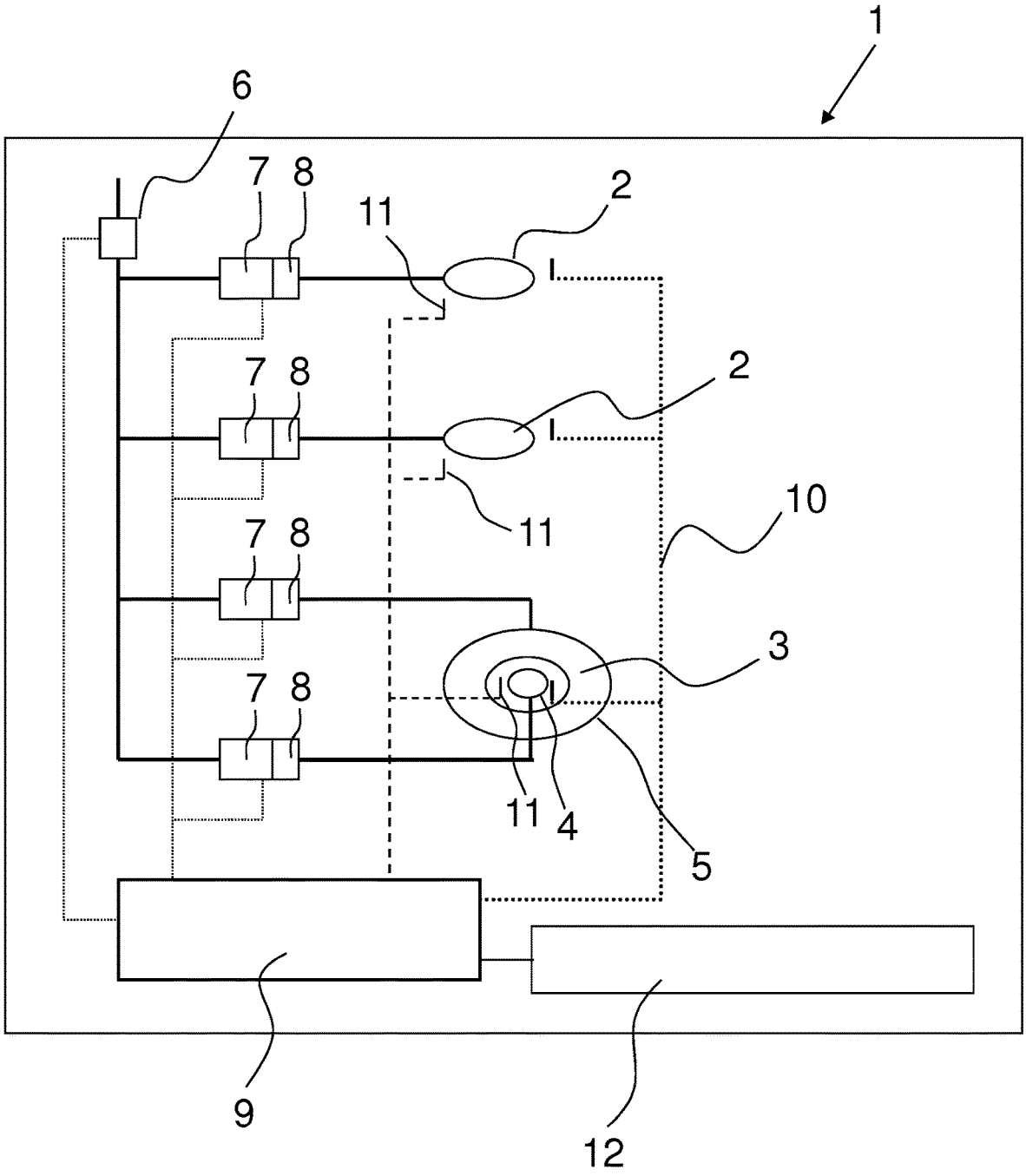
FIG. 1 shows a schematic architecture of a gas cooking appliance.

FIG. 1 shows a schematic architecture of a gas cooking appliance 1. The gas cooking appliance 1 exemplarily comprises two single inlet burners 2 and one double inlet burner 3. The double inlet burner 3 comprises an inner burner ring 4 and an outer burner 5 ring as indicated in FIG. 1, whereas the single inlet burner 2 comprises only one burner ring.

Each of the single and double inlet burners 2 and 3 are connected to a gas inlet 6. For increasing safety of the gas cooking appliance, the gas inlet 6 may comprise a main gas valve for supplying or interrupting gas flow to the gas cooking appliance 1. Between the gas inlet 6 and each single and double inlet burner 2 and 3, in more detail between the gas inlet 6 and each of the burner rings, a safety valve 7 and step valve 8 are provided respectively. This means, that each burner ring can be controlled by respective valve combinations, in particular using and based on an electronic control unit 9 of the gas cooking appliance 1. The electronic control unit 9 may be embodied as a plurality of printed control boards.

The gas cooking appliance 1 may further comprise a flame safety device 10 connected to the electronic control unit 9. The flame safety device 10 may in particular be used to detect if a flame is present or absent at a respective burner ring. Such flame safety device 10 may be embodied in many known ways.

The gas cooking appliance 1 further comprises for each of the burner rings a flame ignition device 11 adapted and designed for igniting gas discharged from a respective gas burner 2, 3 or burner ring. The flame ignition device 11 may be embodied as a device generating an igniting spark or like a device producing a hot surface such as a glow wire. The electronic control unit 9 is connected to the flame ignition device 11 and adapted to control the flame ignition device 11. Similarly, the electronic control unit 9 is connected to respective safety and step valve pairs and adapted to control the safety valve and a corresponding step valve.

The safety valve 7 may for example be a solenoid valve and be provided for opening and closing gas supply to single gas burners 2, 3, in particular burner rings. Opening and closing of such a valve can in particular be executed instantaneously, i.e. without larger time delays. Closing the safety valve will, substantially all at once, shut down gas supply to a respective burner ring, while opening the safety valve will, substantially all at once, enable gas supply to a respective burner ring. Preferably, the safety valve is implemented such that keeping the opened state requires continuously powering the valve. If the power supply to the safety valve fails, the safety valve 7 preferably automatically switches to the closed state, in particular for avoiding uncontrolled escape of gas.

The step valve 8 is provided and adapted for modulating or regulating the gas flow to the gas burner or burner ring. In this way, the output power of a respective gas burner can be modulated, in particular adapted. A respective output power of a gas burner may for example be entered via a user interface 12 of the gas cooking appliance 1. The user interface may include one or more printed circuit boards.

The safety valve 7 and the step valve 8 are both connected to the electronic control unit 9 and can be controlled by the electronic control unit 9 according to respective user settings or user inputs in particular entered via the user interface 12, or according to cooking programs stored in a memory of the gas cooking appliance 1.

The step valve 8 may comprise a stepper motor adapted to actuate a movable part of the step valve 8, in turn changing or varying the gas flow rate through the step valve 8. Such a step valve 8 allows the regulation or modulation of the gas flow in a comparatively precise and repeatable way. Further, the gas flow rate can be varied over a broad range, essentially reaching from the fully opened state to the fully closed state, including essentially all intermediate positions. Changing the gas flow rate via the step valve 8 requires powering the step valve 8, in particular a stepper motor thereof.

The safety valve 7 and step valve 8 may be incorporated in a single valve body. As an example, the respective valve may be a modulating electrovalve. Other single body valves and valve combinations are conceivable, in particular combinations which are able to provide both instantaneous opening and closing of the gas supply, and gas flow regulation.

Figure 2:
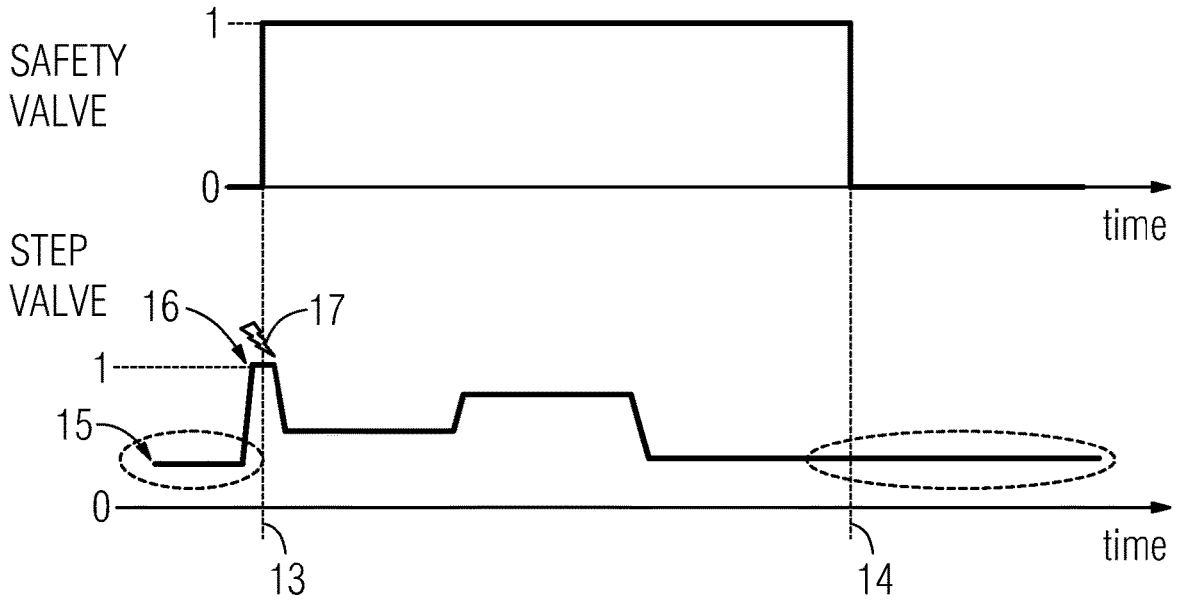
FIG. 2 shows a first process diagram for a single inlet burner.

FIG. 2 shows a first process diagram for a single inlet burner 2. In the process diagram, the valve opening size is drawn versus time t. The upper chart represents the valve opening size over time of the safety valve 7, ranging from fully closed "0" to fully open "1". The lower chart represents the valve opening size over time of the step valve 8. The fully closed state and the fully opened state are indicated by "0" and "1", respectively.

The single inlet burner 2 in the present case is operated in continuous mode, which means that the single inlet burner 2 is constantly powered and constantly emits heating power at least in a time span between an initial start-up 13 and a final shut-off 14.

As can be seen from FIG. 2, the initial start-up 13 comprises the step of transferring the step valve 2 from an initial opening state 15 to an ignition opening state 16, opening the safety valve 2 and generating an ignition spark 17. Note that the initial opening state 15 in the present case is not the fully closed state of the step valve 2 but may be a minimal opening state or size of the step valve 8 in which gas flow through the step valve 8 is still possible. The ignition opening state 16 optionally is the fully opened state of the step valve 2. However, ignition of the gas burner 2 can be executed also at intermediate opening sizes or at the minimal opening size of the step valve 8.

The initial start-up 13 is conducted essentially independent from possible user settings relating to the step valve and directed to the desired output power of the gas burner 2. After successful start-up, the step valve 2 is moved to respective levels for example selected by a user. This is indicated in FIG. 2 by different horizontal lines lying between the initial start-up 13 and the final shut-off 14 of the gas burner 2 and representing valve opening sizes having different output powers.

The final shut-off 14 of the gas burner 2 comprises closing the safety valve 7 while leaving the step valve 8 open at an opening size at the time of closing the safety valve 7. This opening size in the present case corresponds to the initial opening state 15 and may for example be a minimal opening size or state of the step valve 8.

As can be seen from FIG. 2, the initial start-up 13 involves a functional interaction of the step valve 8 and the safety valve 7, whereas the final shut-off 14 only requires a closing action of the safety valve 7. Such operations can be implemented comparatively easy, with a limited number of operational actions or activity of the step valve 8. This is of advantage as the step valve 8 is prone to wear.

Figure 3:
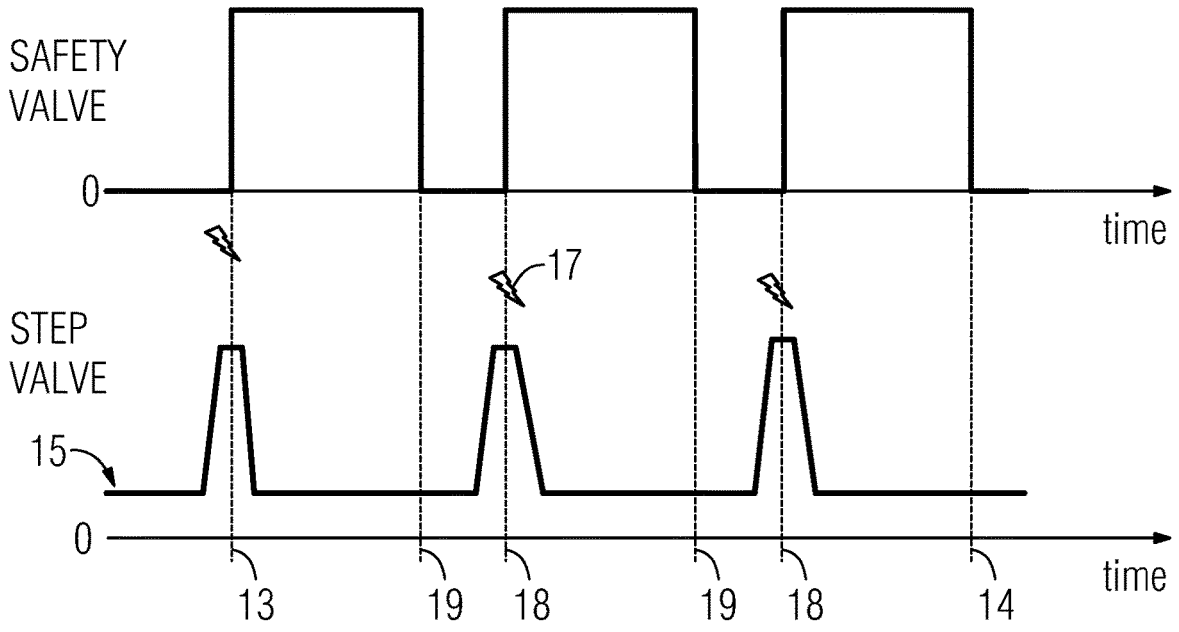
FIG. 3 shows a second process diagram for a single inlet burner.

FIG. 3 shows a second process diagram for the single inlet burner 2. Similar to FIG. 2, the upper chart corresponds to the valve opening size of the safety valve 7 and the lower chart corresponds to the valve opening size of the step valve 8. In contrast to FIG. 2, the process diagram of FIG. 3 corresponds to an intermittent operational mode of the gas burner 2. In the intermittent mode, the heating output power of the gas burner 2 can be lowered below the minimum output power available in continuous mode.

As can be derived from FIG. 3, operation of the gas burner 2 in intermittent mode is similar to a pulse width modulated (PWM) operation of the gas burner 2. The overall output power essentially depends on the duty cycle of the PWM-wise process.

Modulation of the gas supply to the gas burner 2 is accomplished in the intermittent mode by cyclically opening and closing the safety valve 7. Opening and closing of the safety valve 7 respectively go along with a start-up and shut-off operation of the gas burner 2.

The start-up procedures in the intermittent mode, in particular the initial start-up 13 and each intermittent start-up 18 substantially correspond to the initial start-up 13 as shown and described in connection with FIG. 2. One difference is that in intermittent mode the step valve is transferred preferably to the minimal opening size after ignition.

Also, the shut-off procedures, in particular the final shut-off 14 and each intermittent shut-off 19, in the intermittent mode substantially correspond to the final shut off 14 as shown and described in connection with FIG. 2.

As can be seen, the principle of shutting-off and starting-up the gas burner is equal for both continuous mode and intermittent mode operation of the gas burner 2. Respective start-up procedures can be obtained by the combined effect of the safety valve 7 and the step valve 8, whereas respective shut-off procedures only require operation of the safety valve 7.

Figure 4:
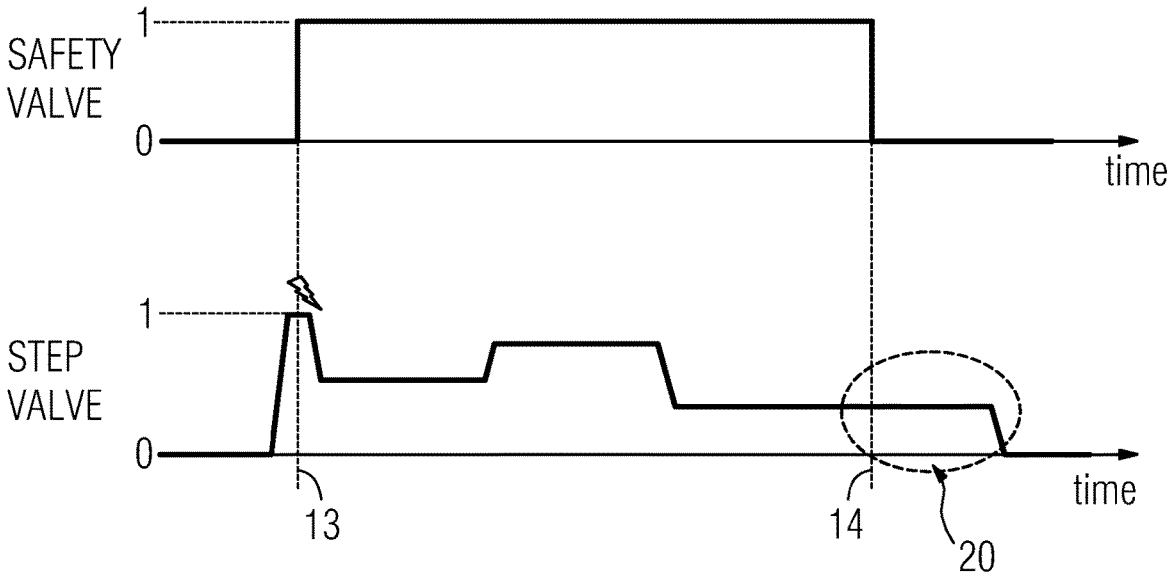
FIG. 4 shows a third process diagram for a single inlet burner.

FIG. 4 shows a third process diagram for the single inlet burner 2. The third process diagram is similar to the first process diagram shown in FIG. 2 and also corresponds to a continuous mode of operation of the gas burner 2. The basic difference to the diagram in FIG. 2 is that upon complete closure of the safety valve 7 in the final shut-off 14 the step valve 8 is gradually transferred to the closed state after an idle time 20 or idle phase of predetermined duration. Complete closure of the step valve 8, also after a certain idle time 20, may be advantageous with respect to safety.

The idle time 20 may for example be a time interval of about a few seconds. However, the idle time 20 or idle phase may be determined by the electronic control unit 9. For example, the idle time 20 can be a time span between the final shut-off 14 and the time point in which the electronic control unit finds or determines that the gas cooking appliance and/or all or one of the gas burners probably will not be used in near future. If the gas burner or gas cooking appliance will not be used in near future it is advantageous for safety reasons to close also the step valve 8. Determining a respective probable or intended use of a gas burner or of the gas cooking appliance 1 may be based on data related to the usage and/operation of a respective burner, the usage, in particular actuation frequency, of the user interface or other parameters.

As the opening state of the step valve 8 is not changed any more after reaching the closed position, a subsequent initial start-up requires driving the step valve from the completely closed state to the ignition opening state, which may be the fully opened state, the minimal opening state or any intermediate state.

It shall be noted, that the step of transferring the step valve 8 to the closed state after a certain idle time may also be used in a final shut-off operation in the intermittent operational mode. Other operational details may be implemented as described above and are not repeated here. However respective details are readily apparent from respective figures.

Figure 5:
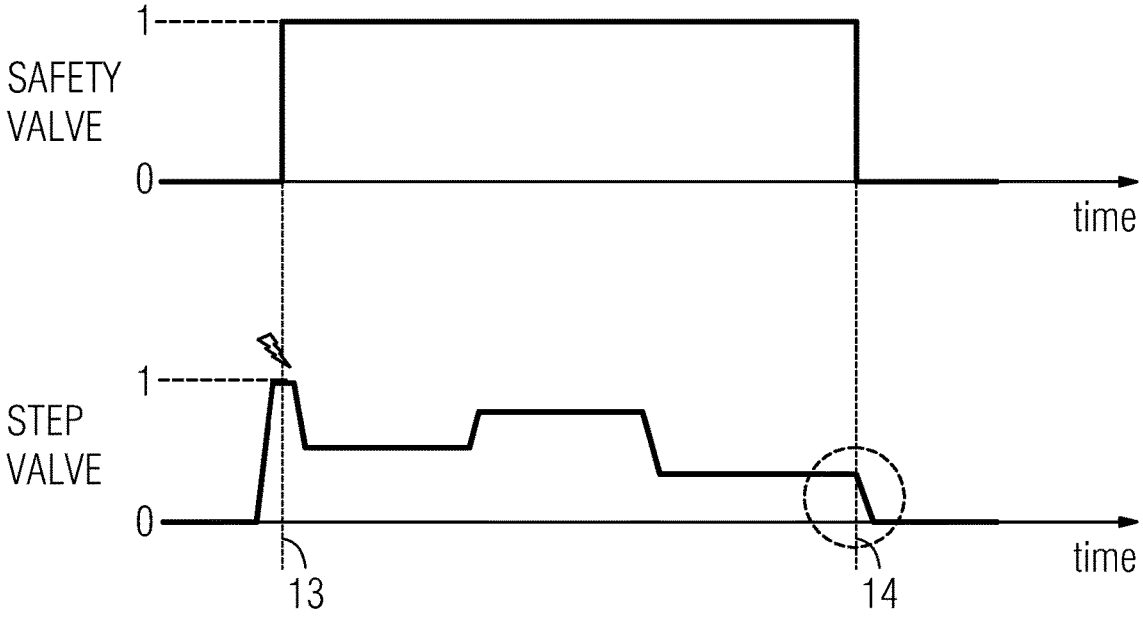
FIG. 5 shows a fourth process diagram for a single inlet burner.

FIG. 5 shows a fourth process diagram for the single inlet burner 2. The fourth progress diagram is similar to that of FIG. 4. The difference between the two process diagrams is that the idle time 20 is omitted in the fourth progress diagram. This means that the step valve 8 is gradually transferred to the closed state immediately after complete closure of the safety valve 7. No idle time is interposed between closure of the safety valve 7 and start of transfer of the step valve 8 to the closed state. Note that the transfer of the step valve 8 to the closed state without providing an idle time may also be implemented in an intermittent operational mode.

Figure 6:
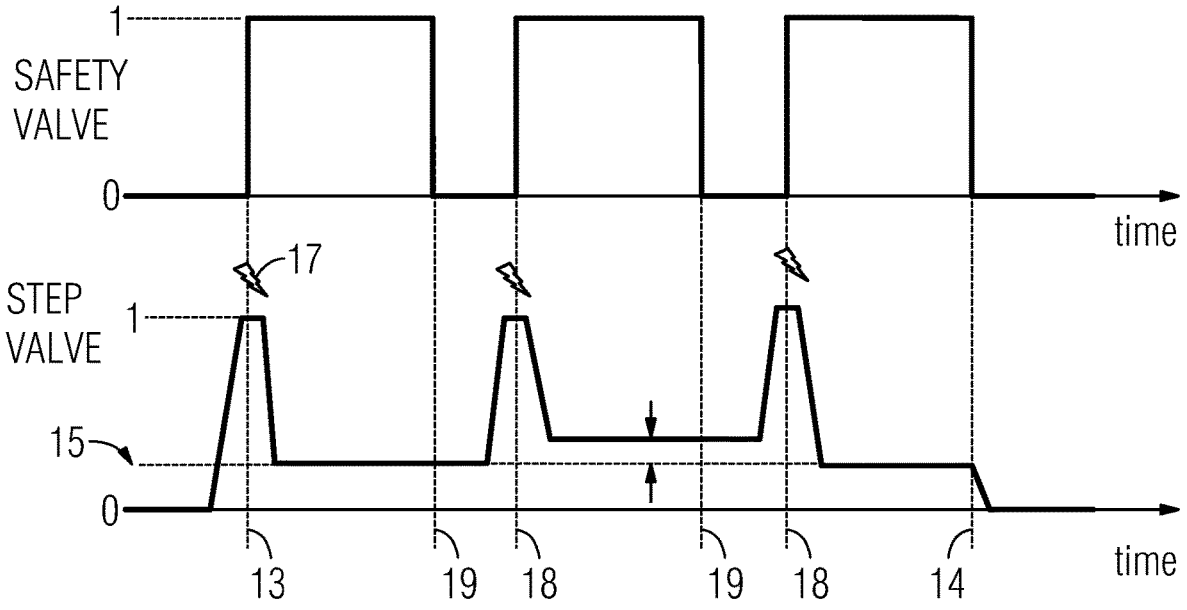
FIG. 6 shows a fifth process diagram for a single inlet burner.

FIG. 6 shows a fifth process diagram for the single inlet burner 2. The fifth process diagram corresponds to an operation in intermittent mode, in which after complete closure of the safety valve 7 in the final shut-off 14, the step valve 8 is gradually transferred or moved to the closed state, similar to the situation in FIG. 5. The fifth process diagram resembles the intermittent mode depicted in FIG. 2, except that the initial and final opening size of the step valve 8 is zero, and that the opening size of the step valve 8 in the second intermittent cycle is higher than the one in the first intermittent cycle.

The opening size in the second intermittent cycle may for example differ from the opening size in the first intermittent cycle in such a way that a 10% increase in the gas flow is obtained. This is indicated by arrows in FIG. 6. In more general terms, it may be provided that odd intermittent cycles are carried out at the initial opening state 15, in particular corresponding to a minimum flow or opening size or state, and that even intermittent cycles are carried out at a higher flow or opening state of the step valve 8. Note that odd and even cycles as mentioned beforehand may be interchanged. Using different opening sizes of the step valve 8 for different intermittent cycles may be used to change the overall heat output without being required to change the duty cycle for the safety valve 7.

Here it shall be mentioned, that the total number of duty cycles and/or intermittent cycles shown in the figures shall not be construed as being fixed. Rather, the number of duty cycles in intermittent mode can more or less be freely selected according to respective needs.

Figure 7:
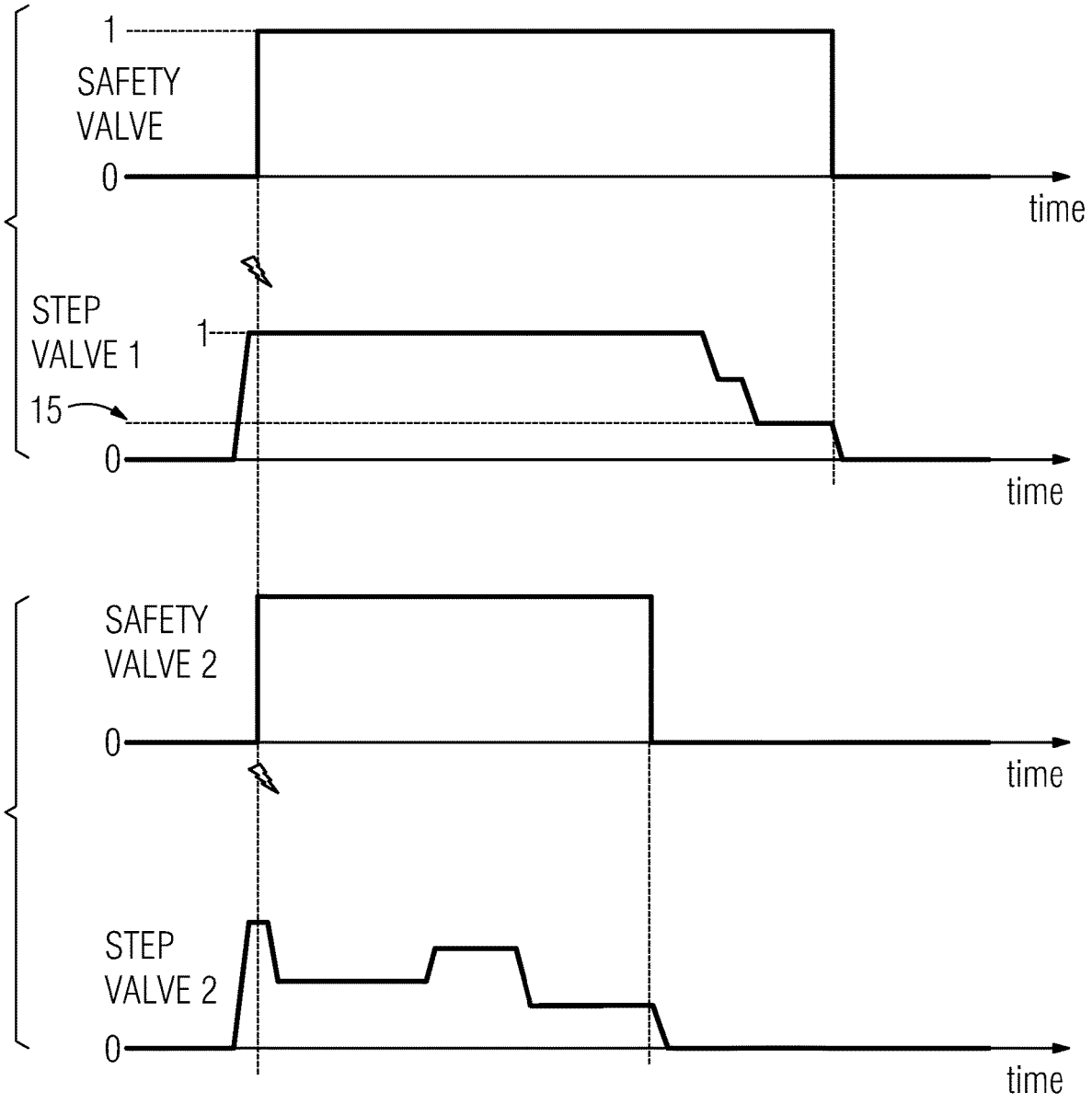
FIG. 7 shows a first process diagram for a double inlet burner.

FIG. 7 shows a first process diagram for the double inlet burner 3. In more detail, the valve opening sizes of a first step valve and a first safety valve of the inner burner ring 4 and a second step valve and a second safety valve of the outer burner ring 5 are depicted over time. Respective diagrams are arranged one below the other in vertical direction. The process diagram of FIG. 7 corresponds to a continuous mode operation of the double inlet burner 3.

If a selected flame level or output power requires igniting only one of the two burner rings, e.g. the inner burner ring 4, a respective continuous mode operation can be conducted as already described in connection with the single inlet burner 2. Reference is made to the description above.

If a respectively selected flame level or output power requires igniting both the inner and outer burner ring 4 and 5, the initial start-up comprises opening the first and second step valve to their ignition opening state, e.g. respectively the maximal opened state, independent of possible flame levels selected by a user, opening the first and second safety valves and, substantially simultaneously igniting the inner and outer burner ring 4, 5.

After ignition, the step valves are moved to respective levels selected by a user for example. The final shut-off of the inner and outer burner ring 4, 5 essentially corresponds to the situation shown in FIG. 5. In FIG. 7, the final shut-off of the inner burner ring 4 does not coincide with the shut-off of the outer burner ring 5. However, it may be that the shut-off time points coincide or are interchanged with respect to their chronological order.

Here it shall be mentioned, that an intermittent mode of operation for the double inlet burner 3 is possible and may comprise operating either the inner burner ring 4 or the outer burner ring 5 in an intermittent operational mode as described further above. In these cases, the respective other burner ring, i.e. the outer burner ring 5 and inner burner ring 4, respectively, remain inactivated. If the selected flame level so requires, and if for example an even distribution of heat over the whole cooking face is required, the inner burner ring 4 and outer burner ring 5 can both be operated in intermittent mode. The intermittent operational cycles of the inner and outer burner ring 4 and 5 may either be independent from each other or they may be synchronized. As to intermittent operation of the inner and outer burner ring reference is made to the description above.

Figure 8:
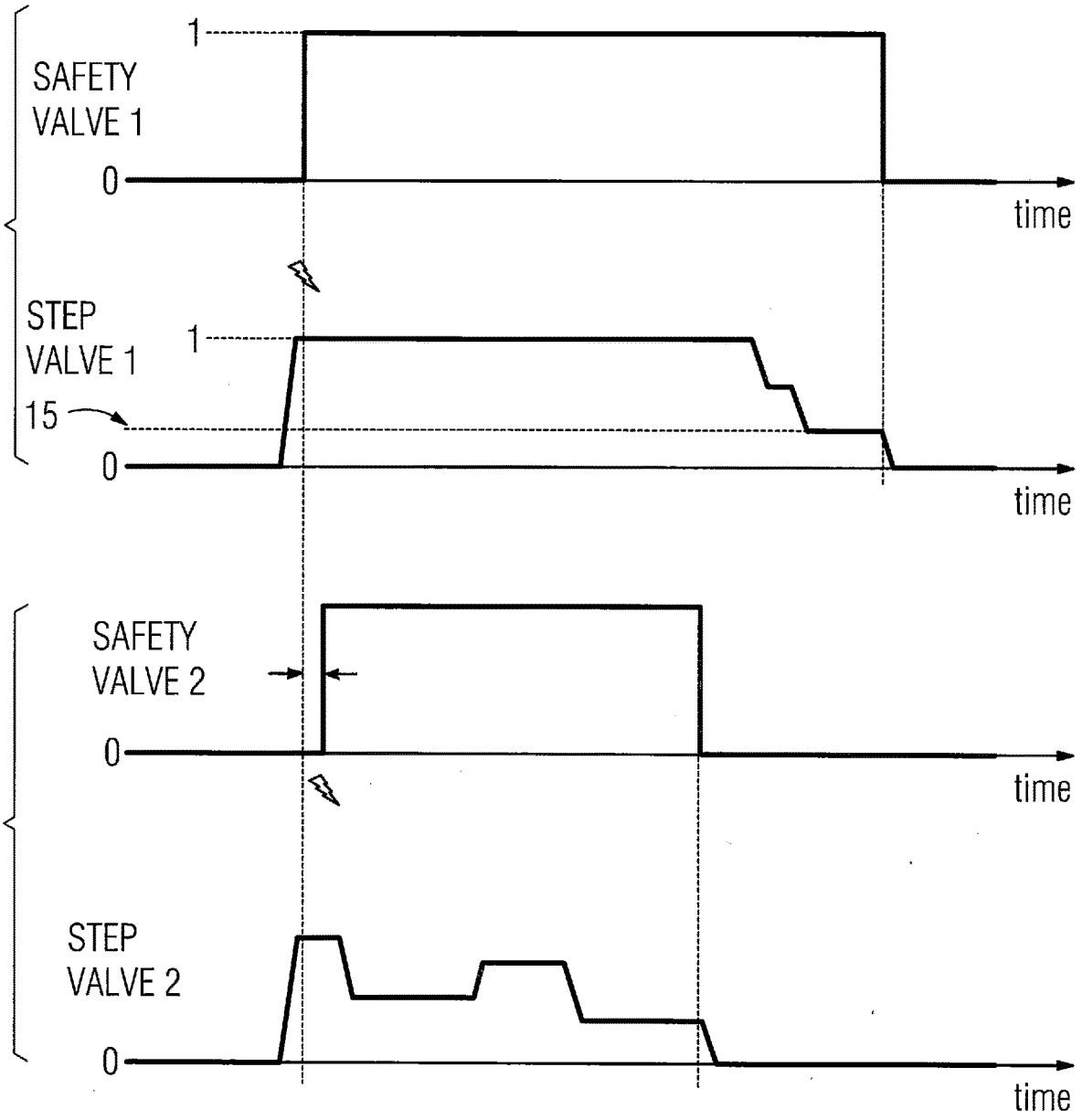
FIG. 8 shows a second process diagram for a double inlet burner.

FIG. 8 shows a second process diagram for the double inlet burner 3. This second process diagram corresponds to a continuous mode of operation involving both the inner burner ring 4 and the outer burner ring 5. The mode of operation shown in FIG. 8 differs from that of FIG. 7 in that the ignition spark of the outer burner ring 5 is generated with a time delay after the ignition spark of the inner burner ring 4. In more detail, first the inner burner ring 4 is ignited and then the outer burner 5 ring is ignited. Note that the sequence of igniting the inner and outer burner rings 4 and 5 can be interchanged. The time delay between the delayed ignition incidents is indicated in FIG. 8 by arrows.

With the proposed principles of start-up and shut off of a gas burner, as extensively discussed above and further above, time delayed ignition processes of the double inlet burner 3 can easily be implemented. The same applies to the examples given throughout the figures. In particular, due to the proposed start-up and shut off processes of a gas burner, which are clearly defined and involve clearly defined opening sizes of the involved safety valve 7 and step valve 8, the operational modes as shown in the figures and other operational modes can easily be implemented. One advantage of the proposed method is that operational movements of the step valve 8 can be reduced to a minimum, which is beneficial for the durability and life time of the step valve 8.

In all, it can be seen, that the proposed operational methods provide improved operational possibilities for gas burners, in particular for gas burners of a gas cooking appliance for professional or household use. It should be also noted that the proposed operational methods may be applied to burners having more than two gas inlets, such as a triple-crown burner wherein crowns are supplied separately and independently from each other with an ignitable mixture of gas and air.

LIST OF REFERENCE NUMERALS

1 gas cooking appliance
2 single inlet burner
3 double inlet burner
4 inner burner ring
5 outer burner ring
6 gas inlet
7 safety valve
8 step valve
9 electronic control unit
10 flame safety device
11 flame ignition device
12 user interface
13 initial start-up
14 final shut-off
15 initial opening state
16 ignition opening state
17 ignition
18 intermittent start-up
19 intermittent shut-off
20 idle time

The invention claimed is:

1. Method of operating a gas burner of a gas cooking appliance wherein the gas burner comprises a safety valve for closing and opening gas supply to the gas burner and a step valve for setting a gas flow rate to the gas burner, wherein the gas cooking appliance comprises an electronic control unit adapted to control the safety valve and step valve, wherein a shut off of the gas burner comprises steps of:

closing the safety valve;

leaving the step valve unchanged for an idle time of a predetermined duration from complete closure of the safety valve; and after said idle time, transferring the step valve to a closed state while the safety valve remains closed wherein the electronic control unit is programmed to determine the predetermined duration of the idle time.

2. Method according to claim 1, wherein upon complete closure of the safety valve, the step valve is gradually transferred to the closed state.

3. Method according to claim 1, wherein the gas burner is operated in an intermittent mode and wherein the shut-off of the gas burner represents an intermittent shut-off.

4. Method according to claim 3, wherein an opening state of the step valve is kept constant at least between the intermittent shut-off and a subsequent intermittent start-up.

5. Method according to claim 3, wherein during intermittent operation, the opening state of the step valve is varied.

6. Method according to claim 1, wherein start-up of the gas burner comprises transferring the step valve to an ignition opening state, opening the safety valve and generating ignition.

7. Method according to claim 6, wherein the gas burner is operated in intermittent mode and the start-up represents an intermittent start-up which comprises transferring the step valve from an open state, to the ignition opening state, opening the safety valve and generating ignition.

8. Method according to claim 6, wherein the ignition opening state corresponds to the fully opened state of the step valve.

9. Method according to claim 1, wherein the gas burner is operated in continuous mode and an opening state of the step valve is adjusted according to user settings or by an automatic control for performing a pre-determined cooking program.

10. Method of operating a gas burner, wherein the gas burner comprises at least a first and second burner ring, wherein at least one of the first and second burner rings is operated according to the method according to claim 7.

11. Method according to claim 10, wherein the gas burner is operated in intermittent mode, and wherein the first burner ring is operated in intermittent mode and the second burner ring is kept in a shut-off state.

12. Method according to claim 10, wherein the gas burner is operated in continuous mode, wherein start-up of the first burner ring is offset from start-up of the second burner ring.

13. Method according to claim 12, wherein the step valves of the first and second burner rings are transferred substantially simultaneously to the ignition opening state.

14. A gas cooking appliance comprising at least one gas burner and a control unit adapted to control the gas burner according to the method of claim 7.

15. A gas cooking appliance according to claim 14 wherein the gas cooking appliance is a cooktop or a gas stove or an oven or a gas hob of professional- or household-type.

16. Method according to claim 1, wherein the predetermined duration of the idle time is based on a usage of the gas burner or a usage of a user interface of the gas cooking appliance.

17. Method according to claim 1, wherein the safety valve is a solenoid valve and the step valve comprises a stepper motor adapted to actuate a movable part of the step valve for changing or varying the gas flow rate to the gas burner.

18. Method of operating a gas burner of a gas cooking appliance wherein the gas burner comprises a safety valve for closing and opening gas supply to the gas burner and a step valve for setting a gas flow rate to the gas burner, wherein the gas cooking appliance comprises an electronic control unit adapted to control the safety valve and step valve, wherein a shut-off of the gas burner comprises steps of:

closing the safety valve;

leaving the step valve unchanged for a predetermined duration of time from complete closure of the safety valve; and after said predetermined duration of time, transferring the step valve to a closed state while the safety valve remains closed wherein the electronic control unit is programmed to determine the predetermined duration of the idle time, and wherein the shut-off represents a final shut-off after an operational phase.

19. Method according to claim 18, wherein start-up of the gas burner comprises transferring the step valve to an ignition opening state, opening the safety valve and generating ignition.

20. Method according to claim 19, wherein the ignition opening state corresponds to the fully opened state of the step valve.

* * * * *